US009957649B2

(12) United States Patent
Liu

(10) Patent No.: US 9,957,649 B2
(45) Date of Patent: May 1, 2018

(54) SOCK STRUCTURE

(71) Applicant: Tsung-Yuan Liu, Shetou Township, Changhua County (TW)

(72) Inventor: Tsung-Yuan Liu, Shetou Township, Changhua County (TW)

( * ) Notice: Subject to any disclaimer, the term of this patent is extended or adjusted under 35 U.S.C. 154(b) by 0 days. days.

(21) Appl. No.: 14/862,206

(22) Filed: Sep. 23, 2015

(65) Prior Publication Data

US 2017/0081793 A1 Mar. 23, 2017

(51) Int. Cl.
*D04B 1/26* (2006.01)
*A41B 11/02* (2006.01)
*D04B 1/10* (2006.01)

(52) U.S. Cl.
CPC ..... *D04B 1/26* (2013.01); *A41B 11/02* (2013.01); *D04B 1/108* (2013.01)

(58) Field of Classification Search
CPC ... D04B 1/26; D04B 9/46; D04B 9/56; D04B 11/28; D04B 11/34; A41B 11/01; A41B 11/02; A41B 11/04
USPC ..... 66/179, 186, 187
See application file for complete search history.

(56) References Cited

U.S. PATENT DOCUMENTS 2,384,079 A * 9/1945 Davis ..... D05B 23/009 2/241
RE24,971 E * 4/1961 Getaz ..... D05B 7/00 112/27
2,980,917 A * 4/1961 Slane ..... D05B 23/009 112/475.09
3,324,686 A * 6/1967 Rosenstein ..... A41B 11/00 2/239
3,457,739 A * 7/1969 Frand ..... D04B 1/26 139/420 R
4,397,161 A * 8/1983 Chesebro, Jr. ..... D04B 1/265 2/239
4,571,960 A * 2/1986 Hursh ..... A41B 11/005 2/239
5,398,626 A * 3/1995 Rosso ..... D05B 27/185 112/470.15
6,550,289 B1 * 4/2003 Higgins ..... A41B 11/005 2/239
7,213,420 B2 * 5/2007 Lynch ..... A41B 11/005 66/186
7,437,896 B2 * 10/2008 Hirao ..... A41B 11/00 2/239
8,156,768 B2 * 4/2012 Green ..... A41B 11/01 66/178 R

* cited by examiner

*Primary Examiner* — Danny Worrell
(74) *Attorney, Agent, or Firm* — Alan D. Kamrath; Kamrath IP Lawfirm, P.A.

(57) ABSTRACT

A sock structure includes a sock body in which a wearer's foot is wrapped. A cuff is provided in an upper end of the sock body, and a toe and a heel are respectively formed at a front end and a rear end of the sock body. An instep is formed at an upside of the sock body, and a contracted opening section is formed in the instep adjacent to the toe. The contracted opening section includes a stitching line by which the contracted opening section is closed and seamed. Depending on the contracted opening section designed on the instep adjacent to the toe, the stitching line stays above the foot toes of a person who wears the sock body and prevents the foot toes from discomfort or injury induced by friction between the foot toes and the stitching line when the sock body is worn on a foot.

4 Claims, 7 Drawing Sheets

SOCK STRUCTURE

BACKGROUND OF THE INVENTION

The present invention relates to a sock structure and, more particularly, to a sock with a closed contracted opening section designed on an instep of the sock.

In the course of manufacturing a conventional sock, an opening at a toe of the sock should be stitched up and closed for development of a thick stitching line at a closed edge of the toe on the sock after a sock body was knitted completely. The stitching line of the conventional sock worn on a person corresponds to the front end of foot toes. Therefore, a person who wears the conventional sock for walks or exercises may feel uncomfortable or be injured (e.g., blisters on skin) at the foot toes which are rubbed by the stitching line. On the other hand, the sock body of the conventional sock is broken easily.

BRIEF SUMMARY OF THE INVENTION

It is an objective of the present invention to provide a sock structure which contributes to contracting a closed edge of a sock for less discomfort or less injury induced by excessive friction between a stitching line and the foot toes of a wearer and for further comfortable wear.

To achieve this and other objectives, a sock structure of the present invention includes a sock body in which a wearer's foot is adapted to be wrapped. A cuff is provided in an upper end of the sock body, and a toe and a heel are respectively formed at a front end and a rear end of the sock body. An instep is formed at an upside of the sock body, and a contracted opening section is formed in the instep adjacent to the toe and includes a stitching line by which the contracted opening section is closed and seamed. The stitching line on the contracted opening section stays above the foot toes of a person who wears the sock body. The contracted opening section is knitted with upper and bottom yarns which interweave rubber covered yarns or elastane for the sock's contracted closed edge. The stitching line of the sock which is worn on a person stays above the person's foot toes, preventing the foot toes from discomfort or injury induced by friction between the foot toes and the stitching line.

In an embodiment, the contracted opening section in which first and second, parallel yarns interweave each other for development of a mesh is knitted with rubber covered yarns added according to a looping ratio of the mesh to the rubber covered yarns of 1:1 or 1:3.

In another embodiment, the contracted opening section in which first and second, parallel yarns interweave each other for development of a mesh is knitted with elastane added according to a looping ratio of the mesh to the elastane of 1:1 or 1:3.

The present invention will become clearer in light of the following detailed description of illustrative embodiments of this invention described in connection with the drawings.

DETAILED DESCRIPTION OF THE INVENTION

The following paragraphs will illustrate the structure in detail and the effect of the embodiments of the present invention with reference to the accompanying drawings.

Figure 1:
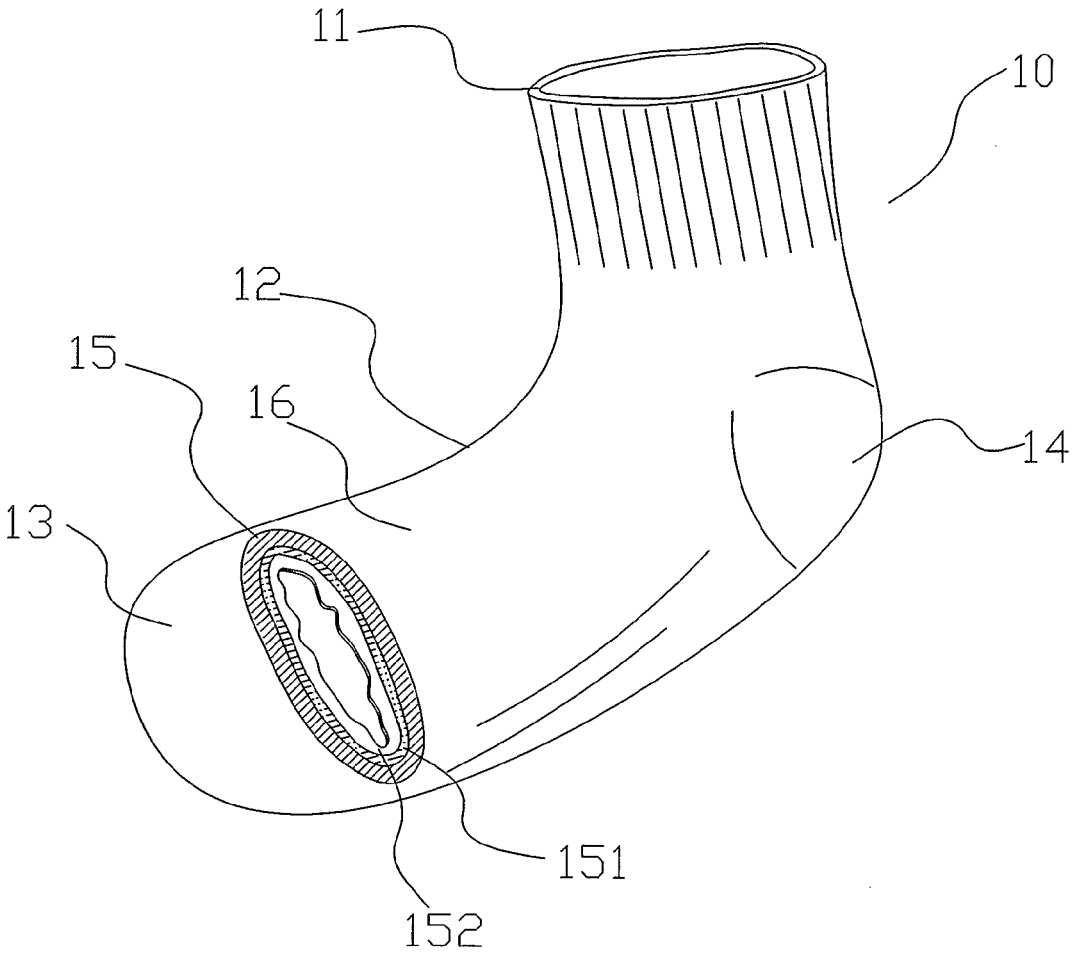
FIG. 1 is a schematic perspective view of a sock according to an embodiment of the present invention in which a contracted opening section is not stitched up.
Figure 2:
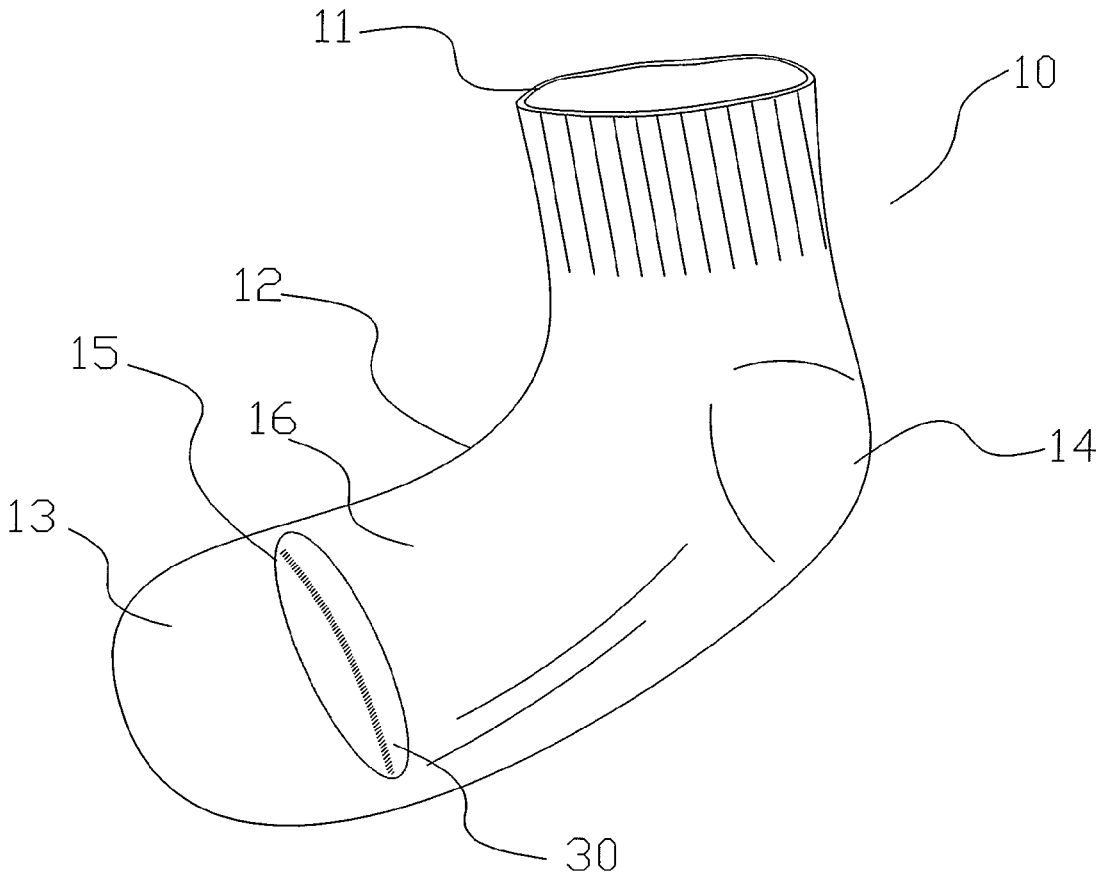
FIG. 2 is a schematic perspective view of the sock of FIG. 1 with the contracted opening section stitched up.

A sock 10 according to an embodiment of the present invention is shown in FIGS. 1 and 2 of the drawings and generally includes a sock body 12 in which a wearer's foot is adapted to be wrapped. A cuff 11 is provided in an upper end of the sock body 12 and adapted to be passed through by a wearer's foot. A toe 13 and a heel 14 are respectively formed at a front end and a rear end of the sock body 12. At the upside of the sock body 12 is an instep 16 which wraps a foot's instep when the sock 10 is worn on a person. Moreover, the instep 16 adjacent to the toe 13 is provided with a contracted opening section 15 including a stitching line 30 by which the contracted opening section 15 is closed and seamed. The stitching line 30 on the contracted opening section 15 stays above the foot toes when the sock 10 is worn on a wearer's foot.

Figure 3:
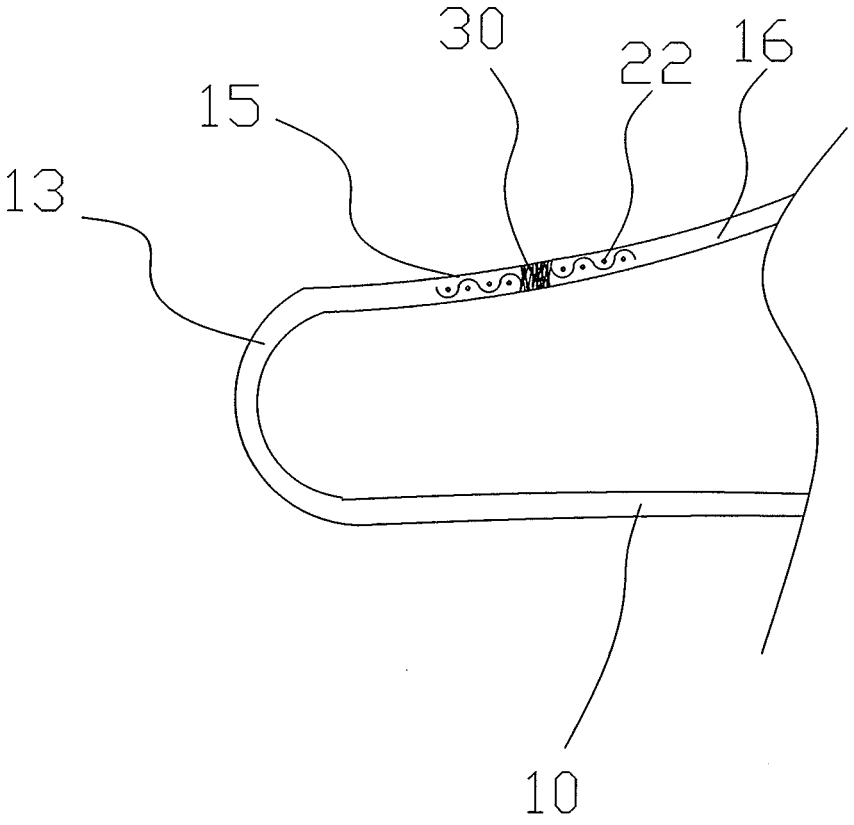
FIG. 3 is a partial, schematic view of the sock of FIG. 2.
Figure 4:
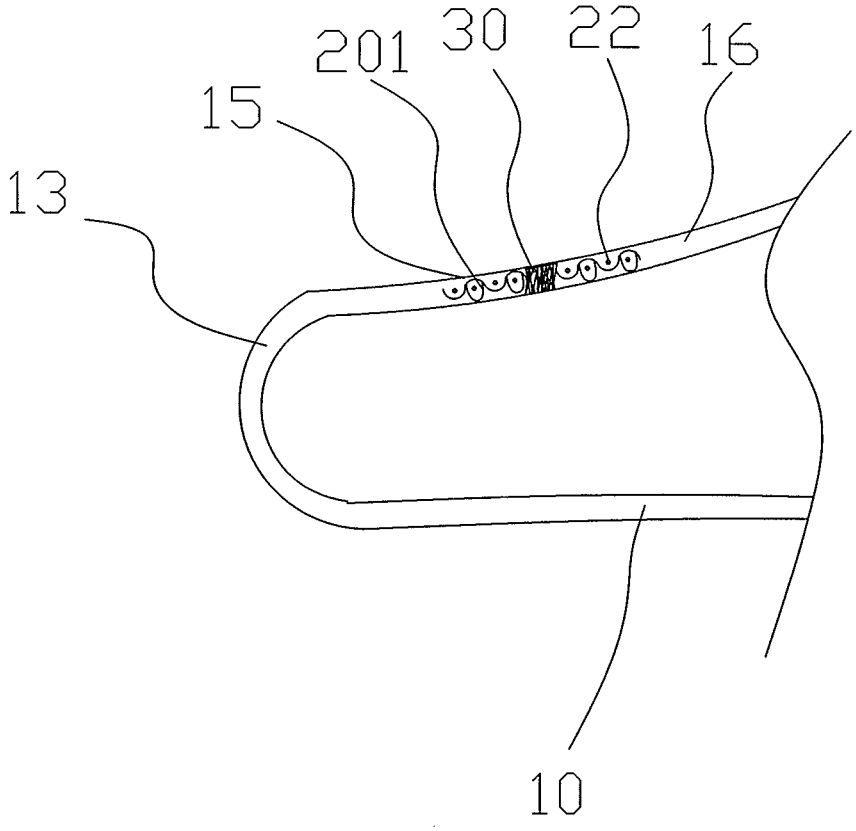
FIG. 4 is a partial, schematic view which illustrates napping knitted among upper yarns in the sock of FIG. 2.
Figure 5:
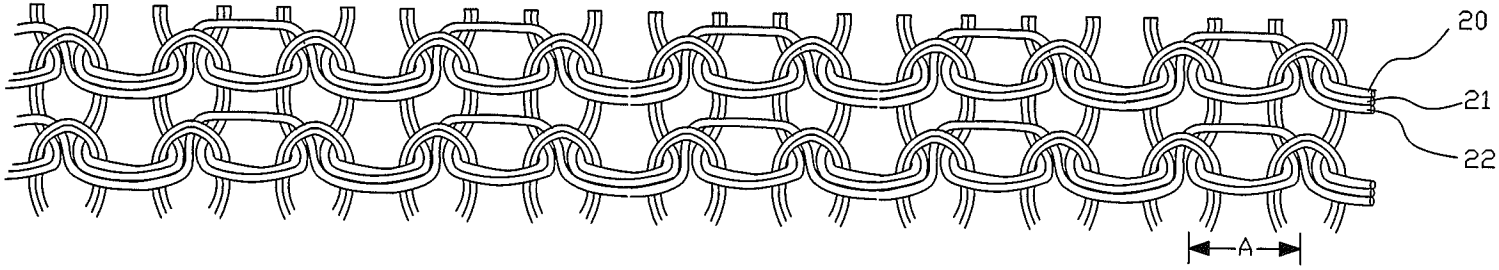
FIG. 5 is a schematic view which illustrates the contracted opening section of the sock of FIG. 1 being knitted.
Figure 6:
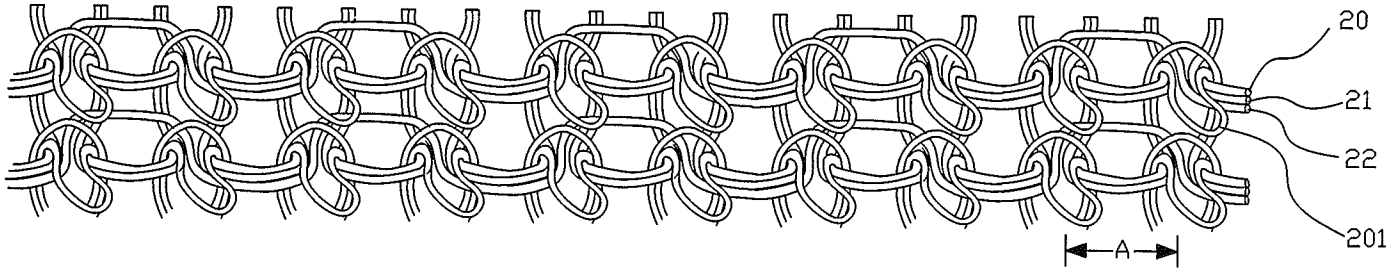
FIG. 6 is a schematic view which illustrates napping knitted in the contracted opening section of the sock of FIG. 1.

In an embodiment for manufacture of the sock 10, the cuff 11, the sock body 12, the toe 13 and the heel 14 are knitted with first and second, parallel yarns 20 and 21, as shown in FIG. 5. Specifically, the cuff 11 followed by the toe 13 and the heel 14 are knitted with the first and second, parallel yarns 20 and 21. In the course of weaving the toe 13, the contracted opening section 15, which includes a stitching section 151 and a residual knitting section 152 (see FIG. 1), is developed on the instep 16 with rubber covered yarns or highly elastic elastane 22 used additionally. In the course of weaving the contracted opening section 15 in which the first and second, parallel yarns 20 and 21 have interweaved the rubber covered yarns or the highly elastic elastane 22, the residual knitting section 152 should be clipped and cut off with the stitching section 151 stitched for development of the stitching line 30 (FIG. 3) and fabrication of the sock 10. In another embodiment, when the first and second, parallel yarns 20 and 21 have interweaved the rubber covered yarns or the highly elastic elastane 22, fluff or napping 201 (see FIGS. 4 and 6) should be knitted with the upper yarns 20 for the flattened contracted opening section 15 and comfort of a wearer.

Figure 7:
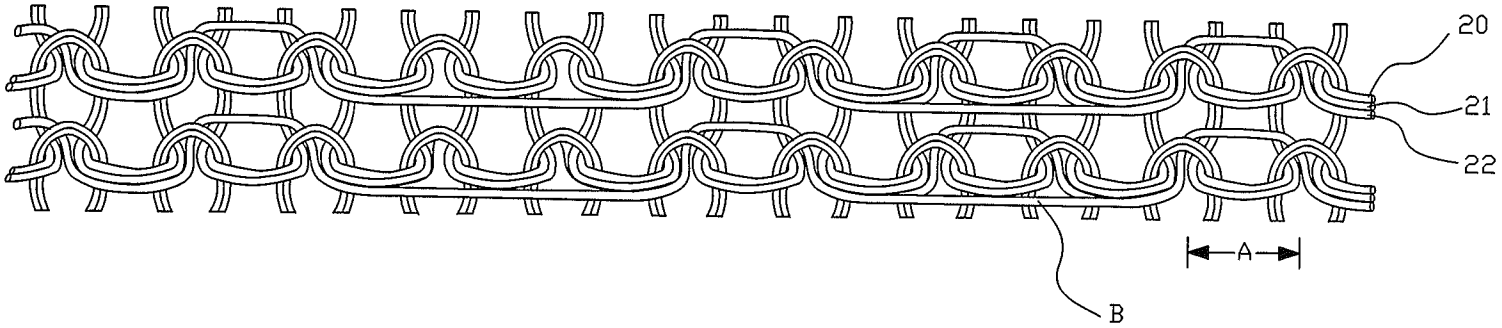
FIG. 7 is a schematic view which illustrates a float loop used in knitting the contracted opening section of the sock of FIG. 1.

In a specific embodiment, the first and second, parallel yarns 20 and 21 based on styling of the sock 10 (for example, ribbed patterns or multicolored yarn interweaving each other) are used in a circular knitting machine in which a computer program is compiled, as shown in FIG. 5 for a mesh (A) weaved by the first and second, parallel yarns 20 and 21. Then, when the contracted opening section 15 is being knitted, the rubber covered yarns or the highly elastic elastane 22 can be added according to a looping ratio of the mesh (A) to the rubber covered yarns or the highly elastic elastane 22 of 1:1 (FIG. 5). Namely, a terry loop formed by the rubber covered yarns or the highly elastic elastane 22 spans or corresponds to one mesh (A). Alternatively, to tighten the closed contracted opening section 15, a float loop (B) for more stitch counts is used when the rubber covered yarns or the highly elastic elastane 22 are added in knitting. The ratio of the float loop stitch counts (the looping ratio of the mesh (A) to the rubber covered yarns or the highly elastic elastane 22) can be set but not limited to 1:3 for the contracted opening section 15 (FIG. 7), which is contracted with the ratio of float loop increased. Namely, a terry loop formed by the rubber covered yarns or the highly elastic elastane 22 spans or corresponds to three meshes (A).

In the sock 10 of the present invention, the stitching line 30 is developed with the contracted opening section 15 closed and located on the instep 16 adjacent to the toe 13. As such, the stitching line 30 of the sock 10 worn on a person just stays on a foot's instep and above the foot toes, differing from a conventional sock which includes a closed stitching line located at the front end of a toe and preventing the foot toes from discomfort or injury induced by friction between the foot toes and the stitching line.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A sock structure comprising:

a sock body in which a wearer's foot is adapted to be wrapped, with a cuff provided in an upper end of the sock body, with a toe and a heel respectively formed at a front end and a rear end of the sock body, with the sock body including an upside, a downside, and first and second sides extending between the upside and the downside to have a circular shape, with an instep formed at the upside of the sock body, with a contracted opening section formed in the instep intermediate and spaced from the toe and the heel and spaced from the first and second sides and the downside, with a stitching line closing and seaming the contracted opening section, wherein the stitching line and the contracted opening section stays above foot toes of the wearer's foot, wherein the stitching line is intermediate and spaced from the toe and the heel and spaced from the first and second sides and the downside, wherein the sock body, the heel and the toe are knitted with first and second, parallel yarns, and, wherein the contracted opening section in which the first and second, parallel yarns interweave each other for development of a mesh is further knitted with rubber covered yarns, wherein a terry loop formed by the rubber covered yarns corresponds to at least one said mesh weaved by the first and second, parallel yarns.

2. The sock structure according to claim 1, wherein the contracted opening section is knitted with the rubber covered yarns added according to a looping ratio of the mesh to the rubber covered yarns of 1:3, with the terry loop formed by the rubber covered yarns corresponding to three meshes.

3. A sock structure comprising:

a sock body in which a wearer's foot is adapted to be wrapped, with a cuff provided in an upper end of the sock body, with a toe and a heel respectively formed at a front end and a rear end of the sock body, with the sock body including an upside, a downside, and first and second sides extending between the upside and the downside to have a circular shape, with an instep formed at the upside of the sock body, with a contracted opening section formed in the instep intermediate and spaced from the toe and the heel and spaced from the first and second sides and the downside, with a stitching line closing and seaming the contracted opening section, wherein the stitching line and the contracted opening section stays above foot toes of the wearer's foot, wherein the stitching line is intermediate and spaced from the toe and the heel and spaced from the first and second sides and the downside, wherein the sock body, the heel and the toe are knitted with first and second, parallel yarns, wherein the contracted opening section in which the first and second, parallel yarns interweave each other for development of a mesh is further knitted with elastic elastane, and wherein a terry loop formed by the elastic elastane corresponds to at least one said mesh weaved by the first and second, parallel yarns.

4. The sock structure according to claim 3, wherein the contracted opening section is knitted with the elastic elastane added according to a looping ratio of the mesh to the elastic elastane of 1:3, with the terry loop formed by the elastic elastane corresponding to three meshes.

* * * * *